US006399550B1

(12) United States Patent
Zehler

(10) Patent No.: US 6,399,550 B1
(45) **Date of Patent: *Jun. 4, 2002**

(54) EXTREME PRESSURE LUBRICANT

(75) Inventor: Eugene R. Zehler, West Chester, OH (US)

(73) Assignee: Cognis Corporation, Gulph Mills, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/687,179

(22) Filed: Jul. 25, 1996

Related U.S. Application Data

(63) Continuation of application No. 08/114,716, filed on Aug. 31, 1993, now abandoned.

(51) Int. Cl.[7] ..... C10M 107/00; C10M 129/70
(52) U.S. Cl. ..... 508/501; 585/10; 585/12
(58) Field of Search ..... 585/10, 12; 508/501

(56) References Cited

U.S. PATENT DOCUMENTS

| | | | | | |
|---|---|---|---|---|---|
| 4,490,265 | A | * | 12/1984 | Holstedt et al. | 252/47.5 |
| 4,601,840 | A | * | 7/1986 | Zehler et al. | 252/565 S |
| 4,758,364 | A | | 7/1988 | Seki et al. | |
| 4,827,064 | A | | 5/1989 | Wu | |
| 4,857,220 | A | | 8/1989 | Hashimoto | |
| 4,877,557 | A | * | 10/1989 | Kaneshige et al. | 282/565 S |
| 4,912,272 | A | | 3/1990 | Wu | |
| 4,956,122 | A | * | 9/1990 | Watts | 585/11 |
| 4,992,183 | A | * | 2/1991 | Beimesch et al. | 252/32.7 E |
| 5,049,291 | A | | 9/1991 | Miyaji et al. | |
| 5,102,567 | A | | 4/1992 | Wolf | |
| 5,180,865 | A | * | 1/1993 | Heilman | 585/10 |
| 5,190,682 | A | * | 3/1993 | Harris | 252/565 S |
| 5,194,168 | A | * | 3/1993 | Aoki et al. | 252/50 |
| 5,358,650 | A | * | 10/1994 | Srinivasan et al. | 252/45 |

FOREIGN PATENT DOCUMENTS

| | | | |
|---|---|---|---|
| EP | 119069 | * | 9/1984 |
| EP | 0088453 | | 5/1987 |
| EP | 0119069 | | 9/1994 |
| EP | 119069 | * | 9/1994 |

OTHER PUBLICATIONS

Thermal Stability Testing of Industrial Gear Oils, Brannen and Lee (Elco Corp.), Oct. 1991, pp. 2–7.

P/PM Technology, Lubrication, Sept./Oct. 1989, pp. 15–17.

Industrial Gear Oils–State of the Art, Andrew G. Papay, 1987, pp. 1–12.

Synthetic Gear Oil Performance, Gordon W. Milligan, Jun. 1985, pp. 49–53.

* cited by examiner

*Primary Examiner*—Jacqueline V. Howard
*Assistant Examiner*—Cephia D. Toomer
(74) *Attorney, Agent, or Firm*—John E. Drach

(57) ABSTRACT

An extreme pressure industrial gear lubricant having enhanced oxidative and thermal stability, lower pour point, and higher viscosity index relative to petroleum-based lubricants is comprised of a poly-α-olefin, a polyol ester, a polybutene oligomer, an antioxidant, and an extreme pressure additive.

2 Claims, No Drawings

EXTREME PRESSURE LUBRICANT

This is a continuation of U.S. patent application Ser. No. 08/114,716, filed Aug. 31, 1993, now abandoned.

BACKGROUND OF THE INVENTION

1. Field of the Invention

This invention relates to industrial extreme pressure gear lubricants having enhanced oxidative and thermal stability.

2. Description of the Related Art

Industrial extreme pressure gear lubricants are used in practically every aspect of the manufacturing and processing industry. Industrial gear lubricants are most frequently used in such components as reduction gears, drive units, screws, slides, chains, and the like. Of the three recognized types of industrial gear lubricants, the most important are the extreme pressure or EP gear oils. In addition to protecting metal parts from corrosion and thermal and oxidative deterioration, EP gear oils must also provide protection against scoring and other types of mechanical distress. EP gear oils are based on petroleum-based or synthetic materials. The petroleum-based EP oils are usually comprised of a petroleum-based material such as mineral oil, an antioxidant, an antifoam, a corrosion inhibitor, and one or more EP additives. In synthetic gear oils, the petroleum-based material is replaced with such synthetic substances as hydrocarbons, esters, polyglycols, phosphate esters, silicones, silicate esters, polyphenyl ethers, and halogenated hydrocarbons depending upon the particular application. It is well known in the art that synthetic gear lubricants tend to last longer, exhibit better high temperature stability, have higher viscosity indexes, and usually have lower pour points than petroleum-based lubricants. Because industrial gear horsepower ratings have increased fourfold over the last 15 years, gear oils are subjected to increasingly higher temperatures which causes a correspondingly shorter service life due to thermal and oxidative degradation. Thus there is always a need for industrial EP gear oils which can provide enhanced oxidative and thermal stability. The compositions according to the invention are industrial gear lubricants having improved high temperature performance, high temperature stability, and cleanliness.

SUMMARY OF THE INVENTION

It has been discovered surprisingly that a composition which is comprised of: (a) a poly-α-olefin which has a viscosity of from 4 centistokes to 100 centistokes @ 100° C.; (b) a polyol ester made by reacting a monocarboxylic acid having from 5 to 18 carbon atoms and a polyol which has at least 3 alcohol functionalities; (c) a polybutene having a molecular weight of from about 700 to about 2500 Daltons; (d) an antioxidant; (e) a sulfur/phosphorus type extreme pressure additive having a specific gravity @ 15.6° C. equal to 1.022; a viscosity in centistokes @ 100° C. equal to 14.3; color according to ASTM D 1500 equal to 4.0; % boron by weight equal to 0.36; % nitrogen by weight equal to 1.21; % phosphorus by weight equal to 1.61; % sulfur by weight equal to 19.6 affords an extreme pressure industrial gear lubricant having enhanced oxidative and thermal stability, and higher viscosity index relative to petroleum-based lubricants and other polyol ester-based lubricants.

DESCRIPTION OF THE PREFERRED EMBODIMENTS

Other than in the operating examples, or where otherwise indicated, all numbers expressing quantities of ingredients or reaction conditions used herein are to be understood as modified in all instances by the term "about".

The poly-α-olefins which can be used in the compositions according to the invention are those which have a viscosity in the range of from about 4 centistokes to about 100 centistokes @ 100° C. Preferred poly-α-olefins are those which have a viscosity in the range of from about 4 centistokes to about 10 centistokes @ 100° C. The amount of poly-α-olefin which can be used in the compositions according to the invention can range from 20% by weight to 90% by weight and will preferably be in the 25% by weight to 55% by weight range.

The polyol esters which can be used in the composition according to the invention are those which can be made by esterifying monocarboxylic acids having from 5 to 18 carbon atoms with a polyol having at least 3 alcohol functionalities examples of which include but are not limited to such polyols as neopentyl glycol (2,2-dimethyl-1,3-propanediol), trimethylolethane [2-methyl-2-(hydroxymethyl)-1,3-propanediol], trimethylolpropane [2-ethyl-2-(hydroxymethyl)-1,3-propanediol], pentaerythritol, dipentaerythritol, glycerine, diglycerine, and triglycerine. The preferred polyol esters are esters of pelargonic acid. The most preferred polyol ester according to the invention is trimethylolpropane tripelargonate. The molecular weight of the polyol esters which can be used can range from 270 to 1,900 with those having a molecular weight of from 480 to 1,400 being preferred. The amount of polyol ester which can be used in the compositions according to the invention can range from 5% by weight to 50% by weight and will preferably be in the 10% by weight to 30% by weight range.

The polybutenes which can be used in the compositions according to the invention are polybutene oligomers having a molecular weight in the range of from 700 to 2500 Daltons with the preferred polybutene having a molecular weight in the range of from 1000 to 1500 Daltons. The amount of polybutene which can be used in the compositions according to the invention can range from 1% by weight to 70% by weight and will preferably be in the 20% by weight to 60% by weight range.

The antioxidants which can be used in the compositions according to the invention are substituted diarylamines, phenothiazines, hindered phenols, or the like. Preferred antioxidants include thiodiethylene bis-(3,5-di-tert-butyl-4-hydroxy) hydrocinnamate, available commercially as Irganox® L 115, a trademark product of Ciba-Geigy and a mixture of dioctyl- and dibutyldiphenylamines, available commercially as Irganox® L 57, a trademark product of Ciba-Geigy and combinations of thiodiethylene bis-(3,5-di-tert-butyl-4-hydroxy) hydrocinnamate and a mixture of dioctyl- and dibutyldiphenylamines. The amount of antioxidant which can be used in the compositions according to the invention can range from 0.05% by weight to 1.0% by weight and will preferably be in the 0.2% by weight to 0.8% by weight range.

The extreme pressure additive which can be used in the compositions according to the invention are thermally stable, sulfur/phosphorus type EP additives such as Lubrizol® 5045 industrial gear oil additive and the like. A typical EP additive will have the following physical properties: (1) specific gravity @ 15.6° C. equal to 1.022; (2) viscosity in centistokes @ 100° C. equal to 14.3; (3) color, ASTM D 1500 equal to 4.0; (5) % boron by weight equal to 0.36; (6) % nitrogen by weight equal to 1.21; (7) % phosphorus by weight equal to 1.61; (8) % sulfur by weight equal to 19.6. The amount of extreme pressure additive which can be used in the compositions according to the invention can range from 1% by weight to 3% by weight and will preferably be in the 1.5% by weight to 2.5% by weight range.

The lubricant compositions according to the invention are typically made by thoroughly mixing all the components together with the aid of conventional mixing equipment while supplying such heating as necessary to maintain fluidity of the mixture.

The following examples are meant to illustrate but not limit the invention.

EXAMPLE 1

Lubricant compositions according to the invention were prepared having the compositions, expressed as weight %, set forth in Table 1.

TABLE 1

| | A | B | C | D | E |
|---|---|---|---|---|---|
| PAE[1] | 52.1 | 46.1 | 40.1 | 34.6 | 29.1 |
| PE[2] | 12.0 | 12.0 | 12.0 | 12.0 | 12.0 |
| PB[3] | 33.5 | 39.5 | 45.5 | 51.0 | 56.5 |
| Anti-ox[4] | 0.20 | 0.20 | 0.20 | 0.20 | 0.20 |
| Anti-ox[5] | 0.20 | 0.20 | 0.20 | 0.20 | 0.20 |
| EP[6] | 2.00 | 2.00 | 2.00 | 2.00 | 2.00 |

[1]Emery ® 3006; a poly-α-olefin having a mole. wt of approx. 530 and a viscosity of 6 Cst @ 100°C.
[2]Emery ® 2934; trimethylolpropane tripelargonate
[3]Indopol ® H-300; a polybutene having a molecular weight in the range of from 1000 to 1500 Daltons; a trademark product of Amoco
[4]Irganox ® L-115
[5]Irganox ® L-57

The data presented in Table 2 show the viscosity index, pour point, viscosity increase & precipitation number as determined under the USS S-200 Oxidation Stability Test protocol for each of the lubricant compositions of Table 1.

TABLE 2

| | A | B | C | D | E |
|---|---|---|---|---|---|
| VI[1] | 124 | 124 | 124 | 124 | 124 |
| P.P.[2] | −45° F. | −35° F. | −30° F. | −25° F. | −15° F. |
| Vis.Inc[3] | <4% | <4% | <4% | <4% | <4% |
| Ppt. #[4] | Trace | Trace | Trace | Trace | Trace |

[1]Viscosity Index
[2]Pour Point
[3]% Viscosity Increase @ 210°F. in USS S-200 Oxidation Stability Test
[4]Precipitation Number in USS S-200 Oxidation Stability Test The data in Table 2 can be compared to the corresponding values for a typical petroleum-based lubricant. For example, the viscosity index for a typical petroleum-based lubricant is 90-100. The greater the viscosity index, the less a particular lubricant's viscosity will change as a function of temperature. The pour point for a typical petroleum-based lubricant is 0F to +10° F. The lower the pour point the better a particular lubricant will flow at lower temperatures and therefore, the better it will lubricate. The % viscosity increase under the USS S-200 protocol must be 6 or less and is typically 5 for acceptable petroleum-based lubricants. The precipitation number under the USS S-200 protocol, which is a measure of the sludge formation, must be less than 0.10 and is typically 0.05 for petroleum-based lubricants.

EXAMPLE 2

Effect of Lubricant Composition on Coking Tendency

The coking tendency of three gear lubricant compositions was determined by the Panel Coke Test and is given in Table 3. The coking tendency measures the likelihood that a particular lubricant will form solid decomposition products when in contact with surfaces at elevated temperatures and is measured by the weight gain of a panel, in milligrams, after the test. The larger the weight gain, the greater the tendency of a particular lubricant to decompose under the test conditions.

Lubricant A is a composition according to the invention and was comprised, in weight % of: (a) 46.8% Emery® 3006; (b) 12.0% a mixture of mono- and dipentaerythritol ester of iso-$C_5$ and n-$C_9$ carboxylic acids having a viscosity of about 5.0 Cst @ 100° C.; 39.0% Indopol® H-300; 0.20% Irganox® L-115; 0.20% Irganox® L-57; and 1.8% Lubrizol® 5045. Lubricant A had a viscosity of 220 Cst @ 40° C. Lubricant B was a standard ISO 220 petroleum-based industrial gear lubricant having 1.8% Lubrizol® 5045 and Lubricant C was a standard ISO 220 petroleum-based gear lubricant containing a typical EP additive other than Lubrizol® 5045. The data show that Lubrizol® 5045 is extremely effective in reducing the amount of solid decomposition products when in contact with surfaces at elevated temperatures as measured by the Panel Coke Test. The data also shows that Lubricant A, a composition according to the invention, exhibits a reduced tendency to form solid decomposition products relative to ISO 220 petroleum-based industrial gear lubricant containing Lubrizol® 5045. An EP additive such as Lubrizol® 5045 is most effective in reducing the amount of high temperature decomposition of gear lubricants when used in combination with $C_{5-18}$ monocarboxylic acid esters of a polyol having at least 3 alcohol functionalities.

TABLE 3

| | Lubricant | | |
|---|---|---|---|
| | A | B | C |
| Panel Wt. Gain (mg) | 6.4 | 8.4 | 147.6 |

EXAMPLE 4

Coking Tendency Test Method

The method is based on Federal Test Standard 791B Method 3462. The apparatus used in the test can be a Roxanna Model C Panel Coker, A Falex Panel Coker, or equivalent.

An aluminum test panel is polished to a dull luster with fine steel wool, washed with petroleum ether, and weighed to the nearest 0.10 milligram. About 270 ml of test oil is poured into the coker body. The test panel is placed above the coker body in the sliding panel runway so that the polished surface is exposed to oil from the splasher. The strip heater is placed above the test panel and tightened securely. The test temperature is monitored by a thermocouple which is inserted are into the test panel. Oil is splashed onto the test panel continuously throughout the duration of the test. The tests are performed for a time period of 4 hours at 260° C. When the test period is over, the coker panel is cooled, removed, and washed with several portions of petroleum ether, and reweighed. The difference in weight of the test panel is reported as coking value.

What is claimed is:

1. A lubricating composition consisting essentially of:

(a) 20 to 90 weight percent of a polyalphaolefin;

(b) 1 to 70 weight percent of isobutylene oligomer, said isobutylene having a molecular weight of about 700 to 2,500 and a viscosity higher than the polyalphaolefin;

(c) 6 to 53 weight percent of lubricant additives effective in reducing the amount of high temperature decomposition of gear lubricants, said additives consisting essentially of the combination of a sulfur/phosphorus extreme pressure additive and at least one $C_{5-18}$ monocarboxylic acid ester of a polyol having at least 3 alcohol functionalities; and (d) up to 1 weight percent of other lubricant additives, exclusive of viscosity index improvers.

2. A lubricating composition according to claim 1 wherein the other lubricating additive consists of at least one antioxidant.

* * * * *